US011506222B2

(12) United States Patent
Luo et al.

(10) Patent No.: US 11,506,222 B2
(45) Date of Patent: Nov. 22, 2022

(54) FAN HOUSING, FAN AND OPERATING SYSTEM HAVING A FAN

(71) Applicant: Carrier Corporation, Palm Beach Gardens, FL (US)

(72) Inventors: Chang Luo, Shanghai (CN); Yuling Shi, Shanghai (CN); XiuHong Jiang, Shanghai (CN); Wei Zheng, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 17/252,746

(22) PCT Filed: Sep. 18, 2019

(86) PCT No.: PCT/US2019/051655
§ 371 (c)(1),
(2) Date: Dec. 16, 2020

(87) PCT Pub. No.: WO2020/068503
PCT Pub. Date: Apr. 2, 2020

(65) Prior Publication Data

US 2021/0254629 A1 Aug. 19, 2021

(30) Foreign Application Priority Data

Sep. 25, 2018 (CN) ..... 201811113742.X

(51) Int. Cl.
*F04D 29/42* (2006.01)

(52) U.S. Cl.
CPC ..... *F04D 29/424* (2013.01); *F04D 29/4233* (2013.01); *F05D 2250/52* (2013.01); *F05D 2250/72* (2013.01)

(58) Field of Classification Search
CPC .. F04D 29/422; F04D 29/4226; F04D 29/424; F04D 29/282; F04D 29/283; F24F 1/0022; F05D 2250/52; F05D 2250/72
See application file for complete search history.

(56) References Cited

U.S. PATENT DOCUMENTS 3,950,112 A * 4/1976 Crump ..... F04D 25/166 415/206
5,997,246 A * 12/1999 Humbad ..... F04D 29/441 415/206

(Continued)

FOREIGN PATENT DOCUMENTS

CN 103742453 A 4/2014
CN 104196761 A 12/2014

(Continued)

OTHER PUBLICATIONS

Nicotra Gebhardt S.p.A., "Centrifugal Fans AT" Issue 2.5 EN, Aug. 2013, 106 pages.

(Continued)

*Primary Examiner* — Justin D Seabe
*Assistant Examiner* — Brian O Peters
(74) *Attorney, Agent, or Firm* — Cantor Colburn LLP

(57) ABSTRACT

The invention relates to a fan housing (1), a fan and an operating system having a fan. The fan housing (1) has a volute shape and includes a volute tongue (2) and a cavity (16) between an air inlet and an air outlet, the volute tongue is provided with a protrusion (20) configured to extend in a direction substantially parallel to an axial direction of an impeller mounted in the cavity and has at least one peak (24) in a longitudinal section of the fan housing, and the peak is opposed to an annular projection (32) located at the circumferential outer surface of the impeller. The use of the invention can effectively reduce the noise level during the (Continued)

operation of the fan and improve fan performance, thereby considerably improving users' comfort and satisfaction.

12 Claims, 4 Drawing Sheets

(56) References Cited

U.S. PATENT DOCUMENTS

| | | | | |
|---|---|---|---|---|
| 6,200,093 | B1 | 3/2001 | Lee et al. | |
| 6,677,564 | B1 | 1/2004 | Sohn et al. | |
| 6,866,480 | B2 | 3/2005 | Canali et al. | |
| 7,284,952 | B2 | 10/2007 | Huang et al. | |
| 8,083,477 | B2 | 12/2011 | Hwang et al. | |
| 8,100,642 | B2 | 1/2012 | Hwang et al. | |
| 8,721,274 | B2 * | 5/2014 | Han | F04D 29/282 415/203 |
| 9,624,932 | B2 * | 4/2017 | Jeon | F04D 29/422 |
| 2009/0145583 | A1 | 6/2009 | Han | |
| 2017/0342992 | A1 | 11/2017 | Pirouzpanah et al. | |

FOREIGN PATENT DOCUMENTS

| | | | |
|---|---|---|---|
| CN | 204082675 | U | 1/2015 |
| CN | 105157104 | A | 12/2015 |
| CN | 104019483 | B | 5/2016 |
| CN | 206071950 | U | 4/2017 |
| CN | 104343732 | B | 8/2017 |
| CN | 107676304 | A | 2/2018 |
| CN | 207080414 | U | 3/2018 |
| CN | 207393572 | U | 5/2018 |
| CN | 105508265 | B | 7/2018 |
| EP | 2781761 | A1 | 9/2014 |
| JP | S5411508 | A | 1/1979 |

OTHER PUBLICATIONS

International Search Report dated Jan. 7, 2020; International Application No. PCT/US2019/051655; International Filing Date Sep. 18, 2019 (6 pgs).

Written Opinion dated Jan. 7, 2020; International Application No. PCT/US2019/051655; International Filing Date Sep. 18, 2019 (7 pgs).

* cited by examiner

FAN HOUSING, FAN AND OPERATING SYSTEM HAVING A FAN

CROSS REFERENCE TO RELATED APPLICATIONS

This application is a National Stage application of PCT/US2019/051655, filed Sep. 18, 2019, which claims the benefit of India Application No. 201811113742.X, filed Sep. 25, 2018, both of which are incorporated by reference in their entirety herein.

FIELD OF THE INVENTION

The present invention relates to the technical field of fan, and in particular, to a fan housing, a fan and an operating system having a fan.

BACKGROUND

Various types of fans have been widely used in lots of devices, equipment or systems such as air conditioners, purifiers, and refrigerated cabinets, which facilitate people's work and daily life. Many fan products have been provided in the prior art to meet different application requirements. However, these existing fan products still have some defects or shortcomings in some aspects such as noise control, space occupation, work efficiency and the like.

SUMMARY OF THE INVENTION

In view of the foregoing, the present invention provides a fan housing, a fan and an operating system having a fan, thereby one or more of the existing problems described above as well as problems of other aspects having been resolved or at least relieved.

Firstly, according to the first aspect of the present invention, it is provided fan housing having a volute shape and including a volute tongue and a cavity between an air inlet and an air outlet, characterized in that the volute tongue is provided with a protrusion configured to extend in a direction substantially parallel to an axial direction of an impeller mounted in the cavity and have at least one peak in a longitudinal section of the fan housing, the peak being opposed to an annular projection located at the circumferential outer surface of the impeller.

In the fan housing according to the invention, optionally, the protrusion comprises:

a first section configured to have a middle protrusion having a radius R1, and two recesses on the sides of the middle protrusion having radiuses R12 and R13 respectively, the peak being positioned in the first section;

a second section configured to have one side having a radius R2 and the other side having the radius R12, the other side having a smooth transitional connection with the first section; and a third section configured to have one side having a radius R3 and the other side having the radius R13, the other side having a smooth transitional connection with the first section.

In the fan housing according to the invention, optionally, the ratio of R1 to R2 ranges from 1.2 to 1.8;

the ratio of R1 to R3 ranges from 1.2 to 1.8;

the ratio of R12 to R2 ranges from 1.6 to 2.4; and/or the ratio of R13 to R3 ranges from 1.6 to 2.4.

In the fan housing according to the invention, optionally, a first trough is arranged at the connection point between the first segment and the second segment, and the ratio of the axial distance D12 between the peak and the first trough, to the distance D2 between the peak and the end of the side of the fan housing adjacent to the second segment, ranges from 0.1 to 0.4; and/or a second trough is arranged at the connection point between the first segment and the third segment, and the ratio of the axial distance D13 between the peak and the second trough, to the distance D3 between the peak and the end of the other side of the fan housing adjacent to the third segment, ranges from 0.1 to 0.4.

In the fan housing according to the invention, optionally, the second section and the third section have the same configuration and are symmetrically disposed on the sides of the first section, and the peak is positioned in the middle portion of the first section.

In the fan housing according to the invention, optionally, the fan housing is provided with a diffuser portion connected to the cavity to allow air to flow out of the air outlet and configured to have a gradually increasing cross section toward the air outlet.

In the fan housing according to the invention, optionally, an angle of 20 to 50 degrees is formed between the lower portion of the diffuser portion and the longitudinal direction of the fan housing.

In the fan housing according to the invention, optionally, the fan housing is provided with two air inlets which are disposed on two sides of the fan housing respectively, and the airflow direction of each air inlet is perpendicular to the end surface of the impeller, and the air outlet is disposed at the tail end of the volute.

In the fan housing according to the invention, optionally, the bottom of the volute shape of the fan housing is configured in a planar shape.

In the fan housing according to the invention, optionally, the annular projection is a partition plate of the impeller.

Secondly, according to the second aspect of the present invention, it is provided a fan comprising the fan housing according to any one of the fan housing descripted above.

In addition, according to the third aspect of the present invention, it is provided an operating system having the fan described above.

In the operating system according to the invention, optionally, the operating system includes an air conditioning system, a purification system, and a refrigeration system.

The principles, characteristics, features and advantages of various technical solutions of the present invention will be clearly understood from the following descriptions in combination with the drawings. For example, it will be understood that, in comparison with the prior art, the technical solutions according to the present invention have significant technical advantages. It can effectively reduce the noise level during the operation of the fan and improve fan performance, thereby considerably improving users' comfort and satisfaction. The invention is suitable to be applied in various operating systems that have a fan, such as an air conditioning system, a purification system, a refrigeration system, and the like.

BRIEF DESCRIPTION OF THE DRAWINGS

The technical solutions of the present invention will be further described in detail below in conjunction with the drawings and embodiments. However, it should be understood that the drawings are designed merely for illustrative purpose and are intended only to conceptually explain the configurations described herein. It is unnecessary to draw the drawings in proportion.

DETAILED DESCRIPTION OF THE INVENTION

Figure 1:
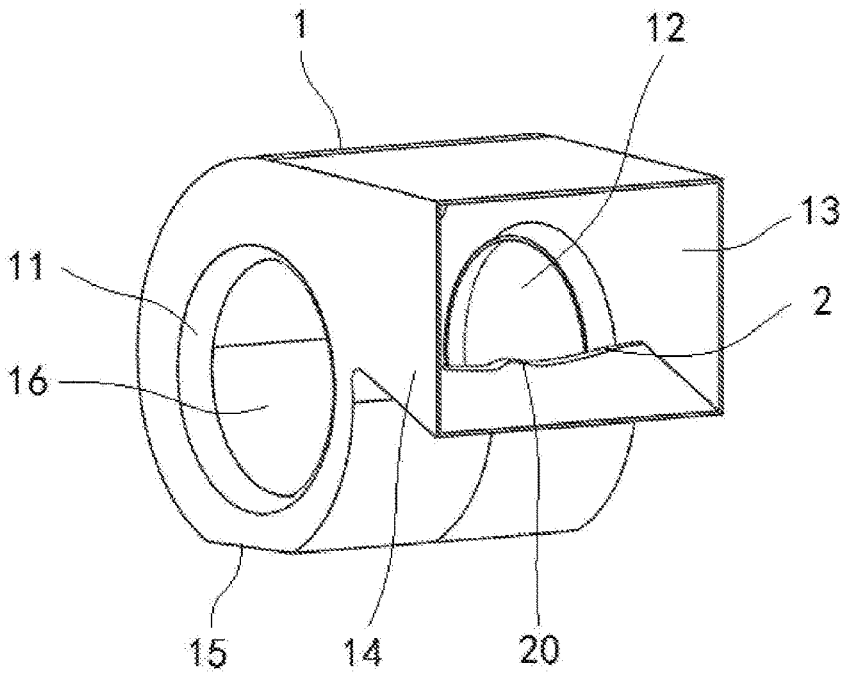
FIG. 1 is a schematic perspective view of a fan housing embodiment according to the present invention.
Figure 2:
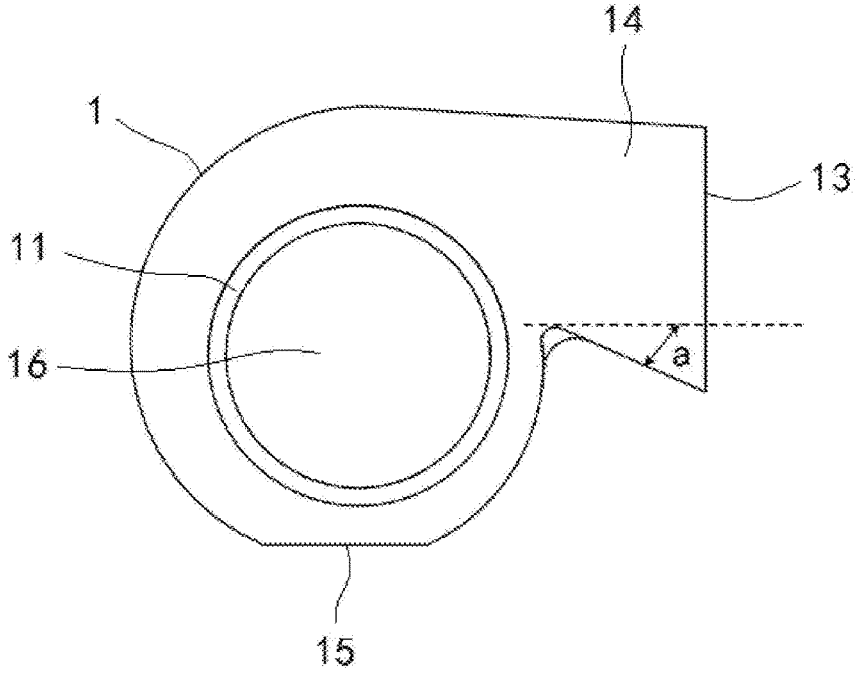
FIG. 2 is a schematic side view of the fan housing embodiment shown in FIG. 1.

First, it should be noted that the configurations, features, and advantages of the fan housing, the fan and the operating system having a fan according to the present invention will be described hereinafter by way of examples. None of these descriptions, however, should be construed in any way as limiting the scope of the invention. In the context of the present application, the technical terms "first", "second", and "third" are used merely for discriminating purposes and are not intended to indicate their order or relative importance. The technical term "substantially" refers to any insubstantial deviation (e.g., 2%, 5%, 8%, etc.) from a given value or shape. The technical terms "upper", "lower", "right", "left", "front", "back", "in", "out" and their derivatives, etc., should be construed with reference to the orientations in the drawings, and the present invention may take a variety of alternative orientations unless expressly stated otherwise.

Moreover, as for any single technical feature described or implied in the embodiments mentioned herein, or any single technical feature described or implied in the various figures, the present invention still allows any further combination or deletion of these technical features (or equivalents thereof), and therefore it should be considered that more of such embodiments according to the invention are also within the scope of the disclosure contained in the application. In addition, the same or similar components and features may be labeled in only one or several places in the same drawing for the sake of simplicity of the drawing.

Referring to FIGS. 1 to 4, the basic configuration of a fan housing embodiment according to the invention is exemplarily illustrated by these drawings. The present invention will be described in detail below with reference to the embodiment.

In this embodiment, a fan housing 1 is configured in the shape of a volute, which adopts the structure of a double inlet header. That is, air inlets 11 and 12 are disposed on the left and right sides of the fan housing 1, respectively, for providing air input, and an air outlet 13 is disposed at the tail end of the volute of the fan housing 1.

Figure 5:
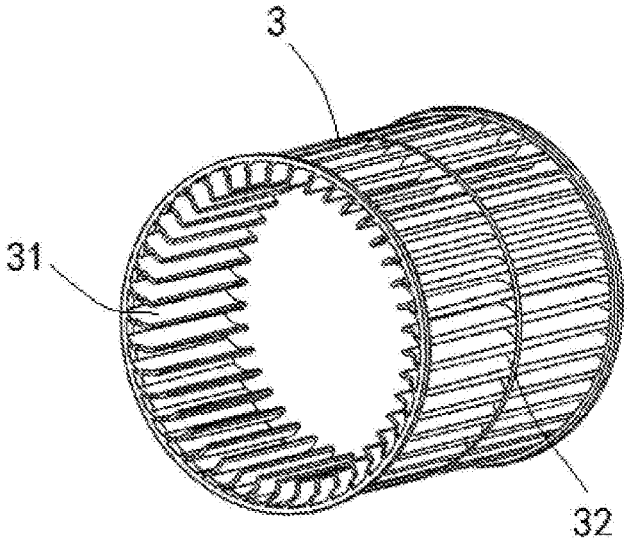
FIG. 5 is a schematic perspective view of an impeller embodiment for being mounted in the fan housing embodiment shown in FIG. 1.

As shown in FIG. 1, a cavity 16 is formed between the air inlets 11, 12 and the air outlet 13 so that an impeller 3 can be placed in the cavity 16. Depending on the conditions of actual applications, such an impeller 3 is generally provided with a plurality of blades which may take a variety of configurations and arrangements. For example, an impeller embodiment is exemplarily shown in FIG. 5, in which a plurality of blades 31 having a relatively short width, are disposed on the inner circumferential surface of the impeller 3.

When the impeller 3 is mounted in the cavity 16, its end face can optionally be kept vertical to the air inlets 11 and 12. By means of the rotational movement of the impeller 3, the airflow can be fostered to enter the inside of the fan housing 1 from the above air inlets 11 and 12, and then flow out of the air outlet 13.

Figure 6:
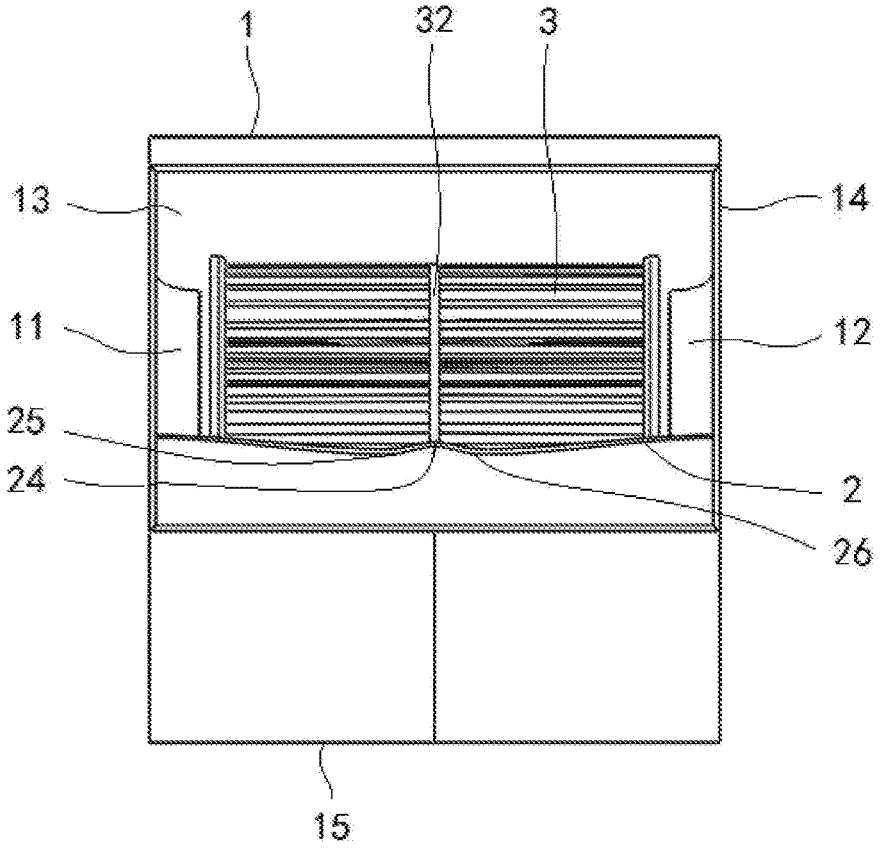
FIG. 6 is a schematic front view illustrating that the impeller embodiment shown in FIG. 5 has been mounted in the fan housing embodiment shown in FIG. 1.
Figure 7:
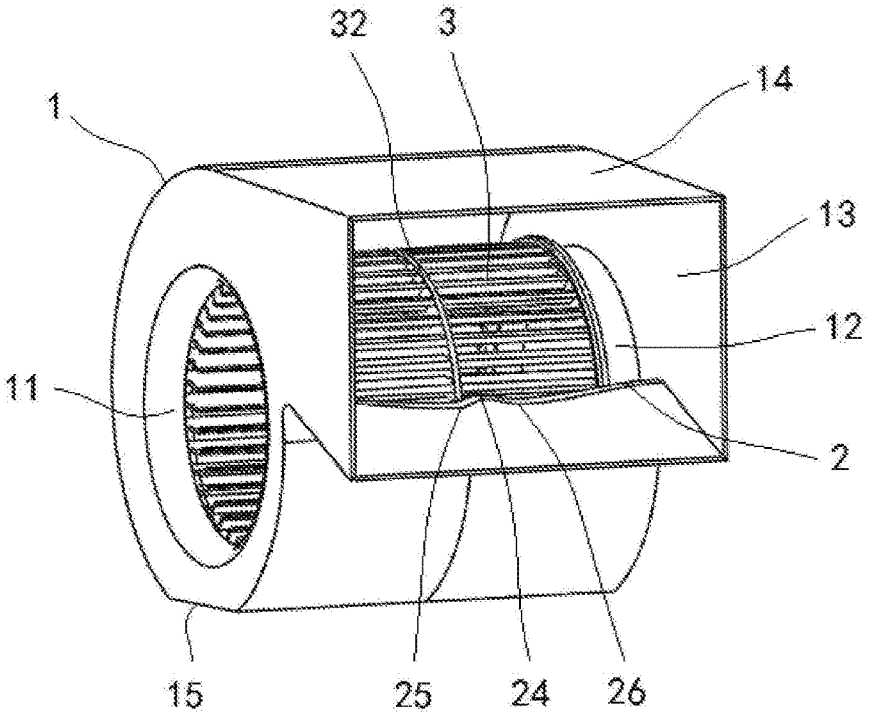
FIG. 7 is a schematic perspective view illustrating that the impeller embodiment shown in FIG. 5 has been mounted in the fan housing embodiment shown in FIG. 1.
Figure 8:
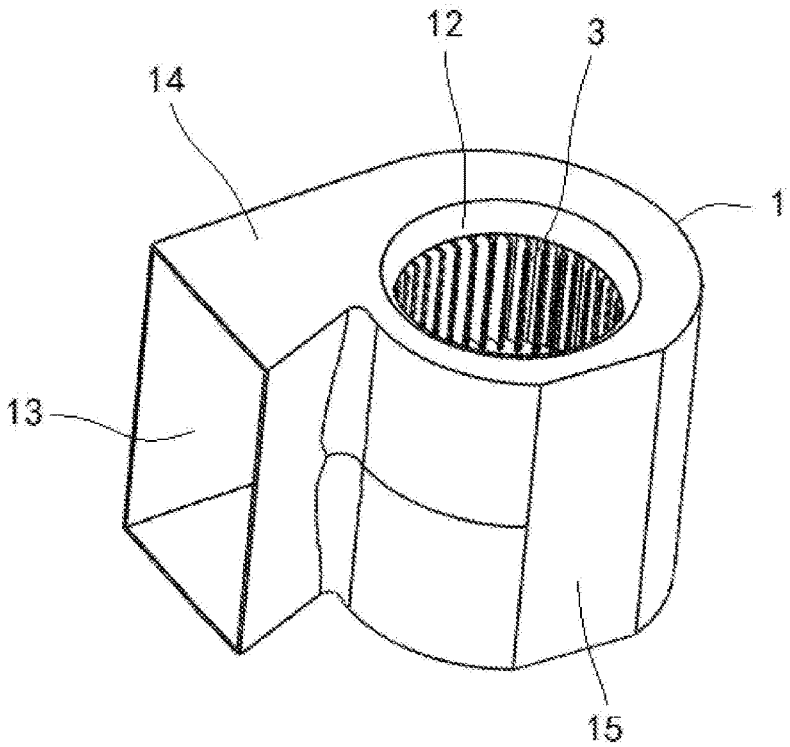
FIG. 8 is another schematic perspective view illustrating that the impeller embodiment shown in FIG. 5 has been mounted in the fan housing embodiment shown in FIG. 1.

Referring to FIG. 1, the fan housing 1 is provided with a volute tongue 2 which has a protrusion 20. Such a protrusion 20 may be configured to extend in a direction substantially parallel to the axial direction of the impeller 3 disposed within the cavity 16 and has a peak 24 on a longitudinal section of the fan housing 1. As shown in FIGS. 6 and 7, such a peak 24 is arranged to oppose an annular projection 32 on the circumferential outer surface of the impeller 3, i.e., the position of the peak 24 on the protrusion 20 and the position of the annular projection 32 on the impeller 3 correspond to each other. In order to ensure that the impeller 3 will not interfere with the volute tongue 2 during normal operation, a gap may be maintained between the annular projection 32 and the peak 24. The gap can be flexibly arranged and adjusted according to the requirements of actual applications.

By adopting the innovative configurations described above, a low-noise fan housing can be achieved, which is able to not only effectively reduce the noise level when the fan is running, but also improve the performance of the fan. This is because the above-mentioned annular projection 32 may be a structural feature directly provided on the circumferential outer surface of the impeller 3, for example, by a processing technology, or may be formed by a part such as an annular partition plate on the impeller, and the inventors have carried out research and found that the presence of such an annular projection 32 will cause a noise problem. Due to the provision of the above-mentioned protrusion 20 on the volute tongue 2, in particular, at a position corresponding to the position of the annular projection 32 on the impeller 3, the lateral flow of fluid from the two sides to the middle will be reduced, improving the flow condition and decreasing the fan noise.

According to the result of an actual comparison test, when an existing fan product was used, an overall noise was generated to reach 40.50 dBA as the air flow rate reached 685 $m^3/h$, whereas when the embodiments of the fan housing and the fan in accordance with the present invention, as shown in FIGS. 1 to 8, were used, the overall noise was measured at 38.09 dBA as the air flow rate reached 695 $m^3/h$. Thus, even when the air flow rate is increased, a considerable noise reduction effect can be obtained and a quieter working environment is available by applying the embodiments of the invention.

It should be noted that the above superior technical effects cannot be achieved with existing volute tongues, for example, in the form of straight lines, C-shape, and the like. The use of the fan housing and the fan in accordance with the invention can increase people's life quality and improve comfort and product satisfaction.

Various flexible designs of the protrusion 20 of the volute tongue 2 may be made according to the requirements of actual applications without departing from the spirit of the invention.

Figure 3:
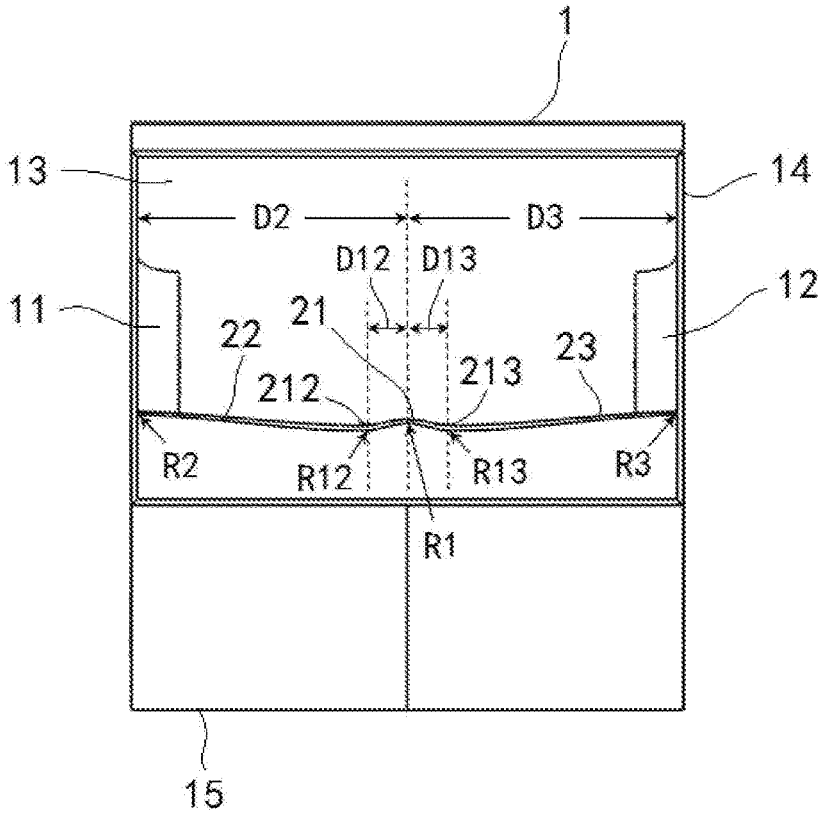
FIG. 3 is a schematic front view of the fan housing embodiment shown in FIG. 1.
Figure 4:
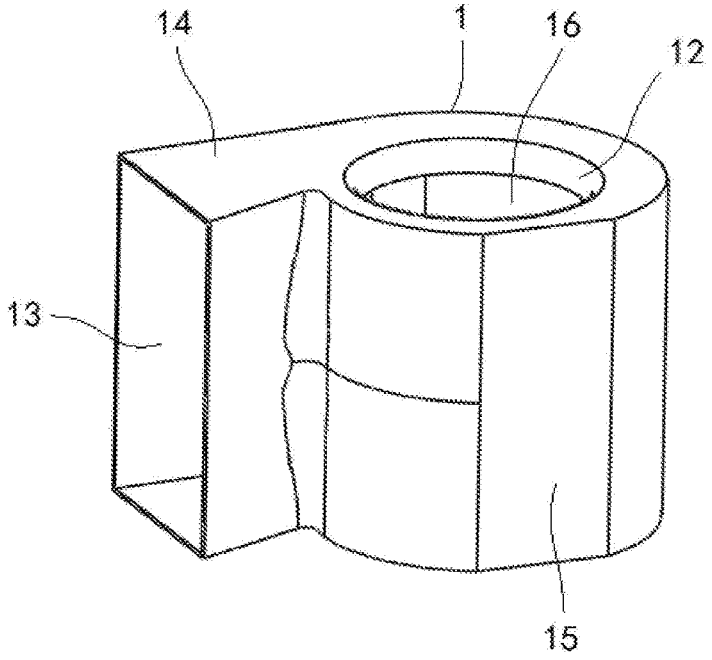
FIG. 4 is another schematic perspective view of the fan housing embodiment shown in FIG. 1.

By way of example, the protrusion 20 may be configured, for example, to have a substantial W shape. Specifically, as shown in FIG. 3, the protrusion 20 may be arranged to have a first section 21, a second section 22 on the left side of the first section 21, and a third section 23 on the right side of the first section 21, wherein the junction point of the first section 21 and the second section 22 is indicated as 212, and the junction point of the first section 21 and the third section 23 is indicated as 213. The first section 21 may be configured to have a shape of linear continuous distribution with a middle protrusion having a radius R1 and two sides having radiuses R12 and R13, respectively. Also, a peak 24 is arranged in the first section 21. The radius of the peak 24 in the plane vertical to the central axis of the impeller is R1, the radius of the junction point 212 in the plane vertical to the central axis of the impeller is R12, and the radius of the junction point 213 in the plane vertical to the central axis of the impeller is R13.

As for the second section 22, it may be configured to have a shape of linear continuous distribution from the side having radius R2 toward the first section 21, as shown in FIG. 3. The second section 22 is disposed on the left side of the first section 21 and has a smooth transitional connection with the first section 21. Such a smooth transitional connection will be helpful to avoid the undesirable noise problem as the airflow passes.

As for the third section 23, it may be configured to have a shape of linear continuous distribution from the side having radius R3 toward the first section 21, as shown in FIG. 3. The third section 23 is disposed on the right side of the first section 21 and has a smooth transitional connection with the first section 21. Such a smooth transitional connection will be also helpful to avoid the undesirable noise problem as the airflow passes.

The inventors have conducted extensive experimental studies, and it has been found through these studies that the above structural parameters can be adjusted and optimized for producing outstanding technical effects. For example, some structural parameters may be modified to affect and adjust the gap between the peak at the protrusion of the volute tongue and the impeller as well as the gap between the trough and the impeller, thereby achieving an overall balance between the fan performance and the noise level.

By way of example, optionally, the ratio of R1 to R2 may be set to range from 1.2 to 1.8. Optionally, the ratio of R1 to R3 may be set to range from 1.2 to 1.8. Optionally, the ratio of R12 to R2 may be set to range from 1.6 to 2.4. Optionally, the ratio of R13 to R3 may be set to range from 1.6 to 2.4.

In addition, as shown in FIGS. 3, 6, and 7, the junction point of the first section 21 and the second section 22 may be set as a first trough 25. The axial distance between the peak 24 on the first section 21 and the lowest point of the first trough 25 is indicated as D12, and the distance between the peak 24 and the left end of the fan housing 1 is indicated as D2. Optionally, the ratio of D12 to D2 may be set to range from 0.1 to 0.4.

Furthermore, referring again to FIGS. 3, 6, and 7, the junction point between the first section 21 and the third section 23 may be set as a second trough 26. The axial distance between the peak 24 on the first section 21 and the second troughs 26 is indicated as D13, and the distance between the peak 24 and the right end of the fan housing 1 is indicated as D3. Optionally, the ratio of D13 to D3 may be set to range from 0.1 to 0.4.

Besides, it should be noted that although in the embodiment given in FIG. 3, a symmetric design is employed for the second section 22 and the third section 23 (i.e., the two sections have the same configuration and they are symmetrically disposed on the left and right sides of the first section 21) and also the peak 24 is disposed in the middle of the first section 21 so that the protrusion 20, as a whole, has a bilaterally symmetrical configuration, the present invention allows, in actual applications, the second section 22 and the third section 23 to have an asymmetrical configuration, and the position of the peak 24 may also be changed to any other location on the first section 21 rather than only be placed at the middle portion of the first section 21. All possible settings may be flexibly designed and adjusted according to the specific application requirements.

Optionally, a diffuser portion 14 may be provided on the fan housing 1 to improve the static pressure recovery of the outward airflow. The diffuser portion 14 is in communication with the cavity 16 to allow the air to flow out of the air outlet 13. As shown in FIGS. 1, 2, 4, 7 and 8, the diffuser portion 14 may be configured to have a gradually expanding shape, that is, to have a gradually increasing cross section toward the air outlet 13. Optionally, an angle a is formed between the lower portion of the diffuser portion 14 and the longitudinal direction of the fan housing 1, which may range from 20 to 50 degrees.

In addition, the bottom 15 of the volute shape of the fan housing 1 may be optionally configured in a planar shape by means of, for example, cutting process, which will reduce the overall height and space occupation of the volute, thereby making the overall structure of the fan housing more compact and the installation layout more flexible.

According to another aspect of the invention, a fan is provided which may employ a fan housing designed according to the present invention, for achieving the afore-mentioned advantages considerably superior than the prior art. For example, a fan embodiment in accordance with the invention is exemplarily illustrated in FIGS. 6 to 8, which employed the fan housing shown in FIGS. 1 to 4 as described above.

Furthermore, according to still another aspect of the invention, it is provided an operating system having a fan which may be designed according to the present invention. It will be appreciated that the operating system in accordance with the invention may include, but is not limited to, an air conditioning system, a purification system, a refrigeration system, and the like.

The fan housing, the fan and the operating system having a fan according to the present invention are exemplified above in detail by way of examples only. These examples are merely illustrative of the principles of the invention and the embodiments thereof, which are not intended to limit the invention. Various modifications and improvements can be made by those skilled in the art without departing from the spirit and scope of the invention. For example, only one peak is exemplarily provided on the protrusion in the foregoing embodiments, according to the conditions of the actual applications, however, a plurality of peaks can be provided on the protrusion of the volute tongue to correspond to all or some of the annular projections, respectively, when a plurality of annular projections are provided on the impeller. Of course, the position of the peak on the protrusion is necessary to be adjusted accordingly when the position of the annular projection is changed or adjusted. As another example, the protrusion of the volute tongue may be arranged to have two sections, four sections or more sections, and one or more peaks (and/or troughs) may be disposed on some of the sections, so as to meet the needs of actual applications better. As yet another example, the fan housing may be arranged to have only one air inlet and one air outlet in some applications. Therefore, all equivalent technical solutions should be considered and construed to be within the scope of the present invention and are defined by the accompanying claims.

The invention claimed is:

1. A fan housing having a volute shape and including a volute tongue and a cavity between an air inlet and an air outlet, characterized in that the volute tongue is provided with a protrusion configured to extend in a direction substantially parallel to an axial direction of an impeller mounted in the cavity and have at least one peak, the peak being opposed to an annular projection located at the circumferential outer surface of the impeller;

wherein the protrusion comprises:

a first section configured to have a middle protrusion having a radius R1, and two recesses on the sides of the middle protrusion having radiuses R12 and R13 respectively, the peak being positioned in the first section;

a second section configured to have one side having a radius R2 and the other side having the radius R12, the other side having a smooth transitional connection with the first section; and a third section configured to have one side having a radius R3 and the other side having the radius R13, the other side having a smooth transitional connection with the first section.

2. The fan housing according to claim 1, wherein:

the ratio of R1 to R2 ranges from 1.2 to 1.8;

the ratio of R1 to R3 ranges from 1.2 to 1.8;

the ratio of R12 to R2 ranges from 1.6 to 2.4; and/or the ratio of R13 to R3 ranges from 1.6 to 2.4.

3. The fan housing according to claim 1, wherein:

a first trough is arranged at the connection point between the first segment and the second segment, and the ratio of the axial distance D12 between the peak and the first trough, to the distance D2 between the peak and the end of the side of the fan housing adjacent to the second segment, ranges from 0.1 to 0.4; and/or a second trough is arranged at the connection point between the first segment and the third segment, and the ratio of the axial distance D13 between the peak and the second trough, to the distance D3 between the peak and the end of the other side of the fan housing adjacent to the third segment, ranges from 0.1 to 0.4.

4. The fan housing according to claim 1, wherein the second section and the third section have the same configuration and are symmetrically disposed on the sides of the first section, and the peak is positioned in the middle portion of the first section.

5. The fan housing according to claim 1, wherein the fan housing is provided with a diffuser portion connected to the cavity to allow air to flow out of the air outlet and configured to have a gradually increasing cross section toward the air outlet.

6. The fan housing according to claim 5, wherein an angle of 20 to 50 degrees is formed between a lower portion of the diffuser portion and an axis parallel to a flow of air out the air outlet.

7. The fan housing according to claim 1, wherein the fan housing is provided with two air inlets which are disposed on two sides of the fan housing, respectively.

8. The fan housing according to claim 1, wherein a bottom of the volute shape of the fan housing is configured in a planar shape.

9. The fan housing according to claim 1, wherein the annular projection is a partition plate of the impeller.

10. A fan, characterized in that the fan comprises the fan housing according to claim 1.

11. An operating system having a fan, characterized in that the fan is the fan according to claim 10.

12. The operating system according to claim 11, wherein the operating system includes an air conditioning system, a purification system, and a refrigeration system.

* * * * *